US007604778B2

(12) United States Patent
Dause

(10) Patent No.: US 7,604,778 B2
(45) Date of Patent: Oct. 20, 2009

(54) CODED TEST TUBES

(76) Inventor: Shari L. Dause, 3938 N. Paulina, Chicago, IL (US) 60613

( * ) Notice: Subject to any disclaimer, the term of this patent is extended or adjusted under 35 U.S.C. 154(b) by 318 days.

(21) Appl. No.: 11/479,229

(22) Filed: Jun. 30, 2006

(65) Prior Publication Data

US 2008/0003148 A1 Jan. 3, 2008

(51) Int. Cl.
*B01L 3/00* (2006.01)

(52) U.S. Cl. ..... 422/102

(58) Field of Classification Search ..... None
See application file for complete search history.

(56) References Cited

U.S. PATENT DOCUMENTS 3,415,627 A * 12/1968 Rait ..... 422/72
4,207,289 A * 6/1980 Weiss ..... 422/104
2003/0047483 A1* 3/2003 Fineberg ..... 206/571
2006/0116270 A1* 6/2006 Hatamian et al. ..... 494/10

* cited by examiner

*Primary Examiner*—Jill Warden
*Assistant Examiner*—Timothy G Kingan
(74) *Attorney, Agent, or Firm*—Wood, Phillips, Katz, Clark & Mortimer

(57) ABSTRACT

A specimen holding device including a test tube having a cylindrical body with one end open and the other end closed, a cap securable to the cylindrical body to close the open end, and a content indicator secured to the tube and separate from the cap. The content indicator extends around the tube near the tube open end and has a selected color matching the cap, where the color is indicative of at least one of a test to be performed on the specimen in the tube and a specimen additive in the tube. The indicator may be a raised elastic ring around the tube cylindrical body and abutting the cap when the cap is secured to the cylindrical body. Alternatively, the indicator may be a colored ring fixed to the tube body around the tube adjacent the tube open end, where the cap overlaps with the content indicator when secured to the cylindrical body.

12 Claims, 2 Drawing Sheets

CODED TEST TUBES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to test tubes and more particularly to test tubes which are coded to indicate content and/or handling information.

BACKGROUND OF THE INVENTION AND TECHNICAL PROBLEMS POSED BY THE PRIOR ART

Test tubes have long been used for collecting and handling specimens of various types to be tested for a variety of reasons. Of course, errors in testing are never desirable, but in certain types of testing such as diagnostic testing of a person's blood, errors are not only undesirable but can have disastrous consequences. Moreover, testing errors can take a variety of forms resulting from other than a failure to perform the test procedures correctly. For example, a test properly performed on the wrong specimen can lead to erroneous results, either by associating proper test results with the wrong patient, or obtaining faulty test results due to the wrong additive being present in the specimen being tested.

As a result, it is not surprising that health care and testing facilities take great caution in properly identifying each specimen in order to prevent misidentification or mistaken testing of any specimen.

For example, when various blood tests are desired in the diagnosis and/or treatment of patients, a phlebotomist is typically given a list of blood draws that need to be collected with the associated tests that need to be performed. The phlebotomist then enters a patient room in the hospital, nursing home, clinic and so on to perform a blood draw, often with a stack of 30 patient labels and a variety of color coded and labeled test tubes such as shown in FIG. 1. For example, blood drawn for a certain test will be drawn into a test tube 10 with a specific color cap 12 and base label 14, whereas blood for testing requiring a particular additive may be drawn into a test tube having the additive and identified by a cap and base label having a different identifying color.

The phlebotomist will go from patient to patient, performing the required blood draw for each patient, in each case adding the secondary (patient identifying) label to the tube(s) containing that patient's blood. Depending on the facility, the completed test tubes may be sent to the laboratory in batches to be processed. Once in the lab, the test tubes may be placed in a robotic rack with the label (typically including a barcode) scanned for identification purposes, and a myriad of tests then performed based on that identification. When in a robotic application site, verification of the tube contents is critical without the use of human intervention.

In those cases in which the lab is not robotic, however, the labeled and closed tubes 10 are placed in a rack and wait for a technician to cycle and perform the tests. In certain stations of testing, the lab technicians may be required to siphoned off (pour off) blood from the tubes 10 to perform other tests. This allows the number of blood draws required from the patients to be minimized, and in some instances is necessary in order to leverage time sensitive tests due to fasting, glucose and so on. In such situations, the technician will typically take the cap 12 off the test tube 10 and then place the tube 10 back in the rack, often with several other samples be in the rack. However, if the secondary label has covered up the entire base label 14, the technician may not be able to see the type of tube that was used (since the color identifying cap 12 is removed, and the color identification on the base label 14 is covered up). In such cases, the technician must peel back the secondary label to try and expose the color identification of the base label 12, which peeling of the label may destroy the base label 12 and make it impossible to see the color identification.

In order to address this concern and also to ensure in robotic applications that the secondary labels are properly aligned (so that their bar code may be properly read to identify the tube), solutions have been sought which attempt to ensure that the secondary label is properly positioned on the test tube (e.g., by placing guide markings on the base labels). In such cases, the lab technician may be required to remove the tube from the line and either (1) remove the label (if possible) and reposition it; or (2) reprint the label, both of which result in wasted time. Further, while proper alignment of the secondary label may protect against the base label being covered up by the patient identifying secondary label, the fact remains that secondary labels are applied often in haste, often by a phlebotomist holding several things at once, and experience has shown that 6%-8% of such labels are commonly misaligned when applied. Therefore, despite such attempts to ensure that the base label 12 is not covered, the previously discussed problems at manual testing sites still arise.

The present invention is directed toward overcoming one or more of the problems set forth above.

SUMMARY OF THE INVENTION

In one aspect of the present invention, a specimen holding device is provided, including a test tube having a cylindrical body with one end open and the other end closed, a cap securable to the cylindrical body to close the open end, the cap having a selected color indicative of at least one of a test to be performed on the specimen in the tube and a specimen additive in the tube, and a content indicator secured to the tube and separate from the cap, the content indicator extending around the tube near the tube open end and having the selected color.

In one form of this aspect of the present invention, the content indicator comprises a raised ring around the tube cylindrical body. In a further form, the raised ring is an elastic ring, and in a still further form the cap abuts the elastic ring when the cap is secured to the cylindrical body.

In another form of this aspect of the present invention, the content indicator comprises a colored ring fixed to the tube body around the tube adjacent the tube open end, and the cap overlaps with the content indicator when secured to the cylindrical body. In a further form, the content indicator is a frosted portion around the open end of the tube with the frosted portion having the selected color.

In still another form of this aspect of the present invention, a label is on the cylindrical body spaced from the cap wherein the label includes markings having the selected color. In a further form, a secondary label is on the cylindrical body with demographics of the patient from whom the specimen was taken.

In another aspect of the present invention, a container for a collected specimen to be tested is provided, including a container body with one end open and the other end closed, a cap securable to the container body to close the open end and having a selected color indicative of at least one of a test to be performed on the collected specimen in the tube and a specimen additive in the tube, a content indicator securable to the container body and separate from the cap wherein the content indicator extends around the container body near the open end and has the selected color, wherein the cap covers a portion of the content indicator when the cap is in a position closing the container body open end.

In one form of this aspect of the present invention, the covered portion of the content indicator faces radially outwardly and the cap is over the content indicator when in the closing position.

In another form of this aspect of the present invention, the covered portion of the content indicator faces toward the container body open end, and the cap abuts the covered portion when in the closing position.

In still another form of this aspect of the present invention, the content indicator is a raised ring around the container body. In a further form, the raised ring is an elastic ring and in a still further form, the cap abuts the elastic ring when the cap is secured to the container body.

In another form of this aspect of the present invention, the content indicator is a colored ring fixed to the container body adjacent the container body open end, and the cap overlaps with the content indicator when secured to the cylindrical body. In a further form, the content indicator is a frosted portion around the container body open end wherein the frosted portion has the selected color.

In still another form of this aspect of the present invention, a label is on the container body spaced from the cap, the label including markings having the selected color. In a further form, a secondary label is on the container body with demographics of the patient from whom the specimen was taken.

In still another aspect of the present invention, a kit for collecting and handling specimens is provided, including a plurality of test tubes, each having a cylindrical body with a closed end and an open end, a plurality of test tube caps, and a plurality of content indicators. Each of the caps is securable to close the open end of one of the test tubes and each of the caps has a distinct one of a selected group of colors wherein each color of the group is indicative of at least one of a distinct test to be performed on the specimen in the tube and a distinct specimen additive in the tube. A plurality of content indicators are securable to the tubes and separate from the caps, wherein each of the content indicators when secured to a tube extends around the tube near the tube open end. Each of the caps is associated with one of the content indicators having a distinct color matching the distinct color of the cap.

In one form of this aspect of the present invention, the content indicators comprise raised rings around the test tubes. In a further form, the raised ring is an elastic ring, and in a still further form at least some of the caps each abut one of the elastic rings having a matching distinct color when the cap is secured to the test tube.

In another form of this aspect of the present invention, at least some of the content indicators comprise a colored ring fixed to the test tube adjacent its open end in a position overlapped by a cap having a matching color when the cap is secured to the test tube. In a further form, the content indicators each comprise a frosted portion around the test tube open end, and the caps are associated with tubes having the frosted portion with a distinct color matching the distinct color of the cap.

In still another form of this aspect of the present invention, a plurality of labels is securable to the test tubes spaced from a cap secured to the tubes, wherein each of the labels including markings having one of the distinct colors matching the distinct colors of an associated cap and content indicator.

DETAILED DESCRIPTION OF THE INVENTION

Figure 3:
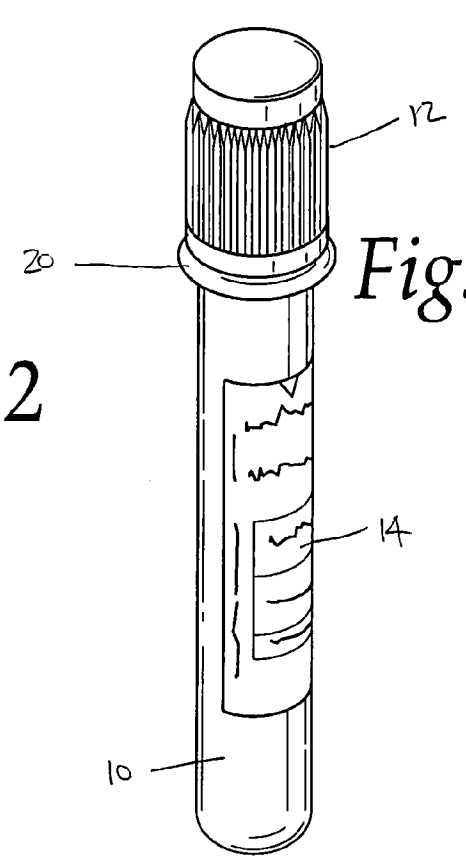
FIG. 3 is a perspective view of the FIG. 2 test tube in a closed condition.
Figure 2:
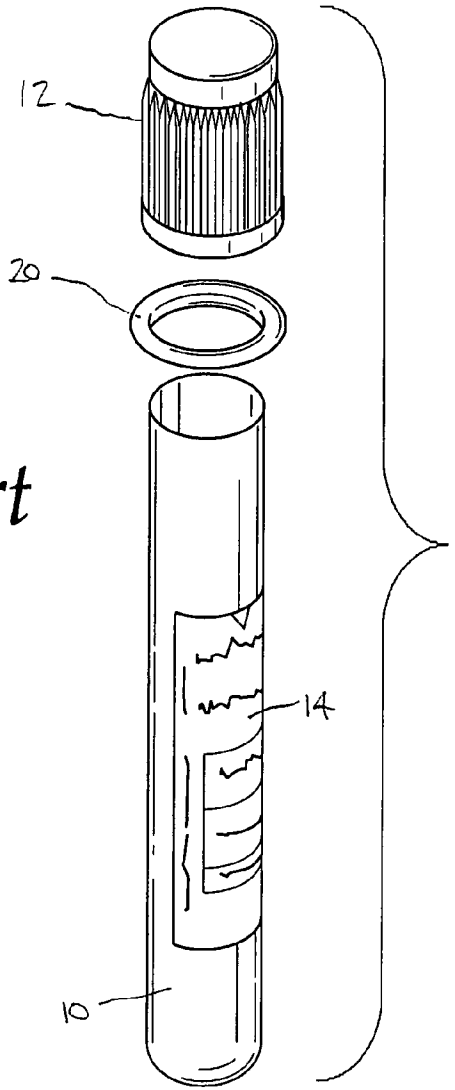
FIG. 2 is an exploded perspective view of a first embodiment of a test tube incorporating the present invention.
Figure 1:
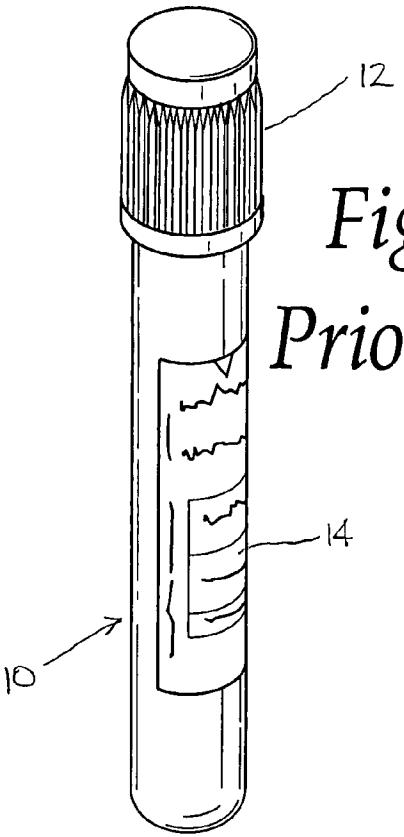
Fig. 1 Prior Art
FIG. 1 is a perspective view of a color coded test tube for collecting a specimen.

A first embodiment of the present invention is illustrated in FIGS. 2-3. Specifically, in this embodiment, a test tube 10 having a base label 14 and closed by a color coded cap 12 such as in the prior art (and illustrated in FIG. 1) are used. The tube 10 may be formed of any suitable material, including glass or plastic. As in the prior art, the cap 12 and portions of the base label 14 may be color coded in order to identify the contents of the tube 10.

In accordance with this embodiment of the present invention, an elastic raised ring 20 is also provided, which ring 20 is color coded to match the color of the cap 12. For example, color coding such as has been heretofore used has included the following color associations:

COLORED CAPS

| COLOR | TEST/ADDITIVE |
|---|---|
| Red marble | SST |
| Blue marble | PST |
| Red | Serum |
| Green | Heparin |
| White | Glucose |
| Purple | EDTA |
| Orange | Lead |
| White/Blue | Citrate |
| Blue | Trace Element |

The present invention may also use the above coding, or still other color coding may be used with the cap 12 and ring 20 (and, if desired, portions of the base label 14) having matching colors.

As should be appreciated from the above table of colors, it should be understood that, as used herein (including the claims), "color" is intended to refer broadly to visually distinguishable characteristics. Accordingly, "color" as used herein refers no only to specific colors of the light spectrum such as red, blue, etc., but also refers to light spectrum colors with textures and/or designs in the surface appearance, such as marble, checkerboard, etc. which may involve more than one light spectrum but which provide visual appearances which may be readily recognized to match the same appearance on a different surface.

The ring 20 of the FIGS. 2-3 embodiment may, in an unstretched state, advantageously have an inner diameter which is less than the outer diameter of the tube 10, whereby the ring 20 will hold itself on the tube 10 when placed thereon. In particular, it should be appreciated that the ring 20 may in an advantageous configuration be round in cross-section so that it may be readily rolled onto the tube 10. Moreover, the ring 20 may be initially placed on the open end of the tube 10 with the cap 12 thereafter pushed on to close the tube 10 and, simultaneously, push the ring 20 down over the tube 10. As a result, when the cap 12 is seated in its closing position on the end of the tube 10, the ring 20 will be adjacent the bottom of the cap 12 as illustrated in FIG. 3.

It should be appreciated that when the cap 12 is thereafter manually removed by a lab technician, the color coded ring 20 will remain on the tube 10. Therefore, even if the technician places the opened tube 10 in a rack with other tubes, he will be able to identify the contents of the tube 10 thereafter based on the color of the ring 20 even if the secondary label covers the base label 14. In that regard, it should be appreciated that it would be virtually impossible for a secondary label to be applied by a technician in a manner which will fully cover the color coded ring 20 so as to prevent the technician from making such an identification. The ring 20 extends fully around the tube 10 and it would be extremely unlikely for the secondary label to be misapplied so badly as to cover the ring 20 all the way around. Moreover, even in that unlikely event, since the ring 20 is raised, the cap 12 will prevent the secondary label from reaching the upper side of the ring 20 no matter how badly the secondary label is misapplied. Therefore, when the cap 12 is removed, the upper side of the ring 20 would still be visible. Still further, even in the further unlikely event that a secondary label were to both cover the entire ring 20 and be inadvertently squeezed down over the top of the test tube 10 after the cap 12 is removed so as to cover the top of the ring 20, the color of the tube 20 may still be visible through the inside of the generally transparent test tube 10 and, in any event, given the raised nature of the ring 20 the secondary label could always be readily removed the minor amount required to expose the color of the ring 20. In short, there is no conceivable way that a technician would be prevented from identifying the tube contents even after the cap 12 is removed.

It should also be appreciated that the above embodiment may be advantageously used with conventional components (i.e., labeled tubes 10 and color coded caps 12). As a result, the advantages of the present invention may be immediately recognized with existing inventories of such components by merely adding an appropriately color coded ring 20 to such capped tubes 10. Moreover, in those instances where it is known definitely that the tubes will not be handled manually at the lab when tested (and therefore the color coding will not be used), the extra expense of the ring 20 may be avoided by not including a ring 20 with the tube 10.

Figure 5:
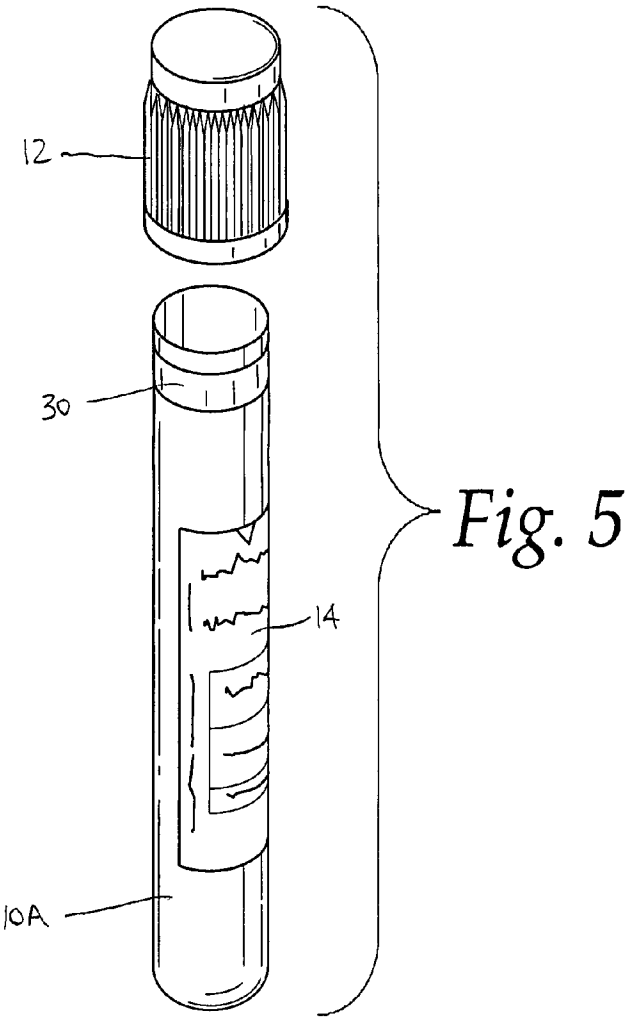
FIG. 5 is a perspective view of the FIG. 4 test tube in an open condition.
Figure 4:
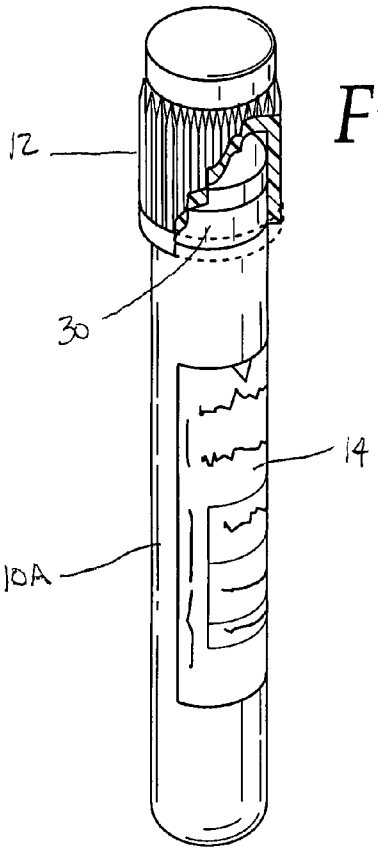
FIG. 4 is a partially broken perspective view of a second embodiment of a test tube incorporating the present invention in a closed condition.

A second embodiment of the present invention is illustrated in FIGS. 4-5. In this embodiment, a modified test tube 10A having a base label 14 and closed by a color coded cap 12 are used. Again, the cap 12 and portions of the base label 14 may be color coded in order to identify the contents of the tube 10A.

In accordance with this second embodiment of the present invention, a colored ring 30 is provided around the upper end of the tube 10A. The colored ring 30 may be a separate color coded label, or it may be integral with the tube 10A itself such as color coded frosting on the outer surface of the tube 10A. The ring 30 may extend to the top of the tube 10A, and may further extend over the top lip of the tube 10A so that, when the cap 12 is removed, the color coding may be seen even when viewing the tube 10A directly from the top end. The ring 30 is advantageously securely fixed to the tube 10A in any event so as to be unaffected by the cap 12 being placed on the tube open end over the ring 30 and to remain in that position when the cap 12 is removed.

When the cap 12 is seated in its closing position on the end of the tube 10A, the ring 30 will be covered by the cap 12 as illustrated in FIG. 4. It should thus be appreciated that the ring 30 will be protected against a secondary label being adhered directly on the ring 30. As a result, when the cap 12 is thereafter manually removed by a lab technician, the color coded ring 30 will be visible notwithstanding the secondary label and, as with the first embodiment, even if the technician places the opened tube 10A in a rack with other tubes, he will be able to identify the contents of the tube 10A thereafter based on the color of the ring 30 even if the secondary label covers the base label 14. For example, should the upper end of the secondary label overlap with the cap 12 and underlying ring 30, that upper end may be torn off with the cap 12 and thereby leave the ring 30 uncovered. Even if the upper end of the secondary label overlaps the ring 30, it is extremely unlikely that it will extend around the entire tube 10A and, in any event, the upper end of the secondary label will be loose above the ring 30 and not pressed down onto and hiding the ring 30. Still further, the color coding of the frosting, or the inside of a label defining the ring 30, the color of the tube 30 may still be visible through the inside of the generally transparent test tube 10A.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A specimen holding device, comprising:

a test tube having a cylindrical body with one end open and the other end closed;

a cap securable to said cylindrical body to close said open end, said cap having a selected color indicative of at least one of a test to be performed on the specimen in the tube and a specimen additive in the tube; and a content indicator secured to said tube and separate from said cap, said content indicator extending around said tube near said tube open end and having said selected color, wherein said content indicator comprises a raised ring around said tube cylindrical body, said raised rings being round in cross-section and abutting said care when said care closes said cylindrical body open end;

wherein when in a position closing said container body open end, said cap covers a portion of said content indicator.

2. The specimen holding device of claim 1, wherein said raised ring is an elastic ring.

3. The specimen holding device of claim 1, further comprising a label on said cylindrical body spaced from said cap, said label including markings having said selected color.

4. The specimen holding device of claim 3, further comprising a secondary label on said cylindrical body with demographics of the patient from whom said specimen was taken.

5. A container for a collected specimen to be tested, said container comprising:

a container body with one end open and the other end closed;

a cap securable to said container body to close said open end, said cap having a selected color indicative of at least one of a test to be performed on the collected specimen in the tube and a specimen additive in the tube; and a content indicator securable to said container body and separate from said cap, said content indicator extending around said container body near said open end and having said selected color;

wherein when in a position closing said container body open end, said cap covers a portion of said content indicator, and said covered portion of said content indicator faces radially outwardly.

6. The container of claim 5, wherein said content indicator comprises a colored ring fixed to said container body adjacent said container body open end, and said cap overlaps with said content indicator when secured to said cylindrical body.

7. The container of claim 6, wherein said content indicator is a frosted portion around the container body open end, said frosted portion having said selected color.

8. The container of claim 5, further comprising a label on said container body spaced from said cap, said label including markings having said selected color.

9. The container of claim 8, further comprising a secondary label on said container body with demographics of the patient from whom said specimen was taken.

10. A kit for collecting and handling specimens, comprising:

a plurality of test tubes, each having a cylindrical body with a closed end and an open end;

a plurality of test tube caps, each of said caps being securable to close the open end of one of said test tubes and each of said caps having a distinct one of a selected group of colors wherein each color of said group is indicative of at least one of a distinct test to be performed on the specimen in the tube and a distinct specimen additive in the tube; and a plurality of content indicators securable to said tubes and separable from said caps, wherein each of said content indicators when secured to a tube extends around said tube near said tube open end, said content indictors comprising raised rings around said tube cylindrical body, said raised rings being round in cross-section and abutting one of said cares when said one care closes said cylindrical body open end;

wherein each of said caps is associated with one of said content indicators having a distinct color matching said distinct color of said cap and when in a position closing said container body open end, said cap covers a portion of said content indicator.

11. The kit of claim 10, wherein said raised rings are elastic rings.

12. The kit of claim 10, further comprising a plurality of labels securable to said test tubes spaced from a cap secured to said tubes, wherein each of said labels including markings having one of said distinct colors matching said distinct colors of an associated cap and content indicator.

* * * * *

UNITED STATES PATENT AND TRADEMARK OFFICE

CERTIFICATE OF CORRECTION

PATENT NO. : 7,604,778 B2
APPLICATION NO. : 11/479229
DATED : October 20, 2009
INVENTOR(S) : Shari L. Dause It is certified that error appears in the above-identified patent and that said Letters Patent is hereby corrected as shown below:

Column 6, line 52, delete "rings" and substitute therefor --ring--;
line 53, delete "care" and substitute therefor --cap--; and
line 54, delete "care" and substutute therefor --cap--.

Column 8, line 16, delete "cares" and substitute therefor --caps--; and
line 16, delete "care" and substutute therefor --cap--.

Signed and Sealed this

Twenty-fourth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,604,778 B2
APPLICATION NO. : 11/479229
DATED : October 20, 2009
INVENTOR(S) : Shari L. Dause It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 430 days.

Signed and Sealed this

Fifth Day of October, 2010

David J. Kappos

David J. Kappos
*Director of the United States Patent and Trademark Office*